US005669642A

United States Patent [19]

Kang

[11] Patent Number: 5,669,642

[45] Date of Patent: Sep. 23, 1997

[54] OUTSIDE DOOR HANDLE AUTOMATIC LOCKING DEVICE FOR AUTOMOBILES

[75] Inventor: Sun Won Kang, Seoul, Rep. of Korea

[73] Assignee: Hyundai Motor Company, Seoul, Rep. of Korea

[21] Appl. No.: 655,238

[22] Filed: Jun. 5, 1996

[51] Int. Cl.[6] ..... E05B 3/00

[52] U.S. Cl. ..... 292/336.3; 292/DIG. 22; 292/DIG. 65

[58] Field of Search ..... 292/336.3, 347, 292/DIG. 22, DIG. 65

[56] References Cited

U.S. PATENT DOCUMENTS

| | | | |
|---|---|---|---|
| 2,864,641 | 12/1958 | Leslie | 292/336.3 |
| 3,719,248 | 3/1973 | Breitschwerdt et al. | 292/DIG. 22 X |
| 3,967,844 | 7/1976 | Torii et al. | 292/DIG. 65 X |
| 4,402,547 | 9/1983 | Weston et al. | 292/DIG. 22 X |

FOREIGN PATENT DOCUMENTS

| | | | |
|---|---|---|---|
| 2003342 | 11/1969 | France | 292/DIG. 65 |

*Primary Examiner*—Rodney M. Lindsey

*Attorney, Agent, or Firm*—Finnegan, Henderson, Farabow, Garrett & Dunner, L.L.P.

[57] ABSTRACT

The present invention provides an outside door handle automatic locking device for automobiles which includes supports that are placed on both sides of the upper portion of a housing, levers, placed on both sides of a handle and inwards from the supports, which, because of being fixed to a hinge shaft, are able to rotate. Also, an elastic member is formed on the hinge shaft that keeps the outside handle in its original position through its elasticity. Additionally, placed on a fixed location on one of the levers is a rotating member that rotates when the vehicle receives a side impact from a collision. A hook portion is also offered which is fixed toward the outside of the rotating member and catches the rotating member when it rotates past its fixed rotation.

6 Claims, 3 Drawing Sheets

OUTSIDE DOOR HANDLE AUTOMATIC LOCKING DEVICE FOR AUTOMOBILES

BACKROUND

The present invention relates to the outside door handle on automobiles, and more particularly, to an outside door handle automatic locking device for automobiles that automatically maintains its locked state during a side collision.

At looking at the formation for the assembly of outside door handles, as can be seen in FIG. 1, one can find supports 4 that are placed on both sides of the upper portion of a housing 2 and a lever 8 that has two sides which are placed on both sides of an outside handle 6 and inwards from the supports 4, which, because of being fixed to a hinge shaft 10, are able to rotate.

Also, an elastic member 12 is placed around one side of the hinge shaft as a torsional coil spring. One side of the lever 8 of the outside handle is biased by one free end of the elastic member 12, and the housing 2 is biased by the other free end of the elastic member 12, which, through this biasing, the lower part of the outside handle 6 is kept inside the concave portion of the of the housing 2.

In this way, when wanting to enter the vehicle, one pulls on the outside handle 6, opens the door and enters the vehicle.

This outside handle 6, by rotating on the hinge shaft 10, moves the outside handle rod (not shown in drawings). By this action, the lock on the latch is released and the opening and closing of the door is made possible.

This type of outside door handle assembly, because it allows the door to open if the automobile is involved in an accident where it receives a side collision, has devised a safety precaution in the locking means.

In this locking means, a balance weight is mounted on the upper portion of the outside handle lever to maintain a center of gravity on the outside handle. By doing so, if the door receives a blow from a side collision, it is prevented from opening even if the outside door handle is unintentionally rotated.

But the above locking means, as it depends solely on the balance weight if the outside door handle is unintentionally rotated, can not be a completely reliable safety device as the range of accidental rotation of the outside handle can be to such an extent as to allow the opening of the door, regardless of the placement of the balance weight.

Also, enough space must be alloted the balance weight after taking into consideration its rotation. As a result, there is an increase in the amount of unneeded space.

SUMMARY

The present invention has been made in an effort to solve the above problems.

The object of the present invention is to provide an outside door handle automatic locking device for automobiles that securely and automatically maintains its locked state in the event of a side collision. The door, by staying locked, and thus closed, provides safety to the driver and passengers. Also, as the amount of space used to mount the device is minimized, the amount of available utilization space is increased.

The achieve the above object, the present invention provides an door outside handle automatic locking device for automobiles comprising:

supports that are placed on both sides of the upper portion of a housing;

a lever, placed on both sides of an outside handle and inwards from the supports that can rotate as a result of being fixed to a hinge shaft;

an elastic member that is formed on the hinge shaft and keeps the door outside handle in its initial state by the elasticity of the elastic member;

a rotating member that is placed on a fixed location of the lever and is able to rotate when receiving an impact from a side collision; and a hook portion that is formed toward the outside of the rotating member and catches the rotating member when it rotates past its fixed rotation.

The rotating member the rotating member has a fixed mass so as to be able to rotate when the impact force over a predetermined level is given to the door comprises:

a saw-toothed portion which is formed on the outside part of the rotating member The hook portion, the hook portion, formed on the inside portion of the support that supports the door outside handle, faces the saw-toothed portion and comprises itself saw teeth.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DESCRIPTION

Preferred embodiments of the present invention will now be described in detail with reference to the accompanying drawings.

Figure 1:
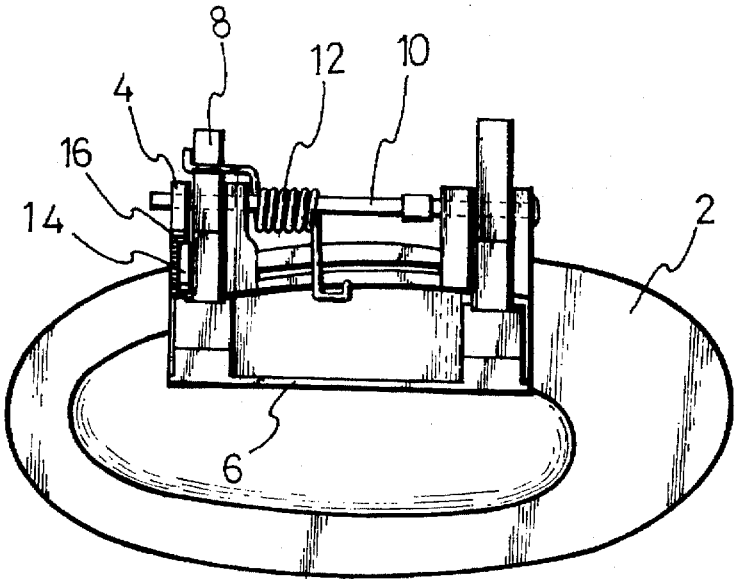
FIG. 1 is a rear view of an outside door handle assembly in accordance with a preferred embodiment of the present invention.

FIG. 1 is a rear view of an outside door handle assembly in accordance with a preferred embodiment of the present invention. The outside door handle assembly includes supports 4 that are placed on both sides of the upper portion of a housing 2. On both sides of an outside handle 6, levers 8 are placed, inwards from the supports 4. The levers 8 are fixed on a hinge shaft 10 and are able to rotate as a result of this placing.

Also, an elastic member 12, used as a torsional coil spring, is fixed to one side of the hinge shaft 10. One side of the lever 8 of the outside handle is biased by one free end of the elastic member 12, and the housing 2 is biased by the other free end of the elastic member 12, which, through this biasing the lower part of the outside handle 6 is kept inside the concave portion of the housing 2. If the outside handle 6 is pulled, the outside handle 6 rotates on the hinge shaft 10 and moves the outside door handle rod(not shown). In this way, the door is able to be opened.

Figure 2:
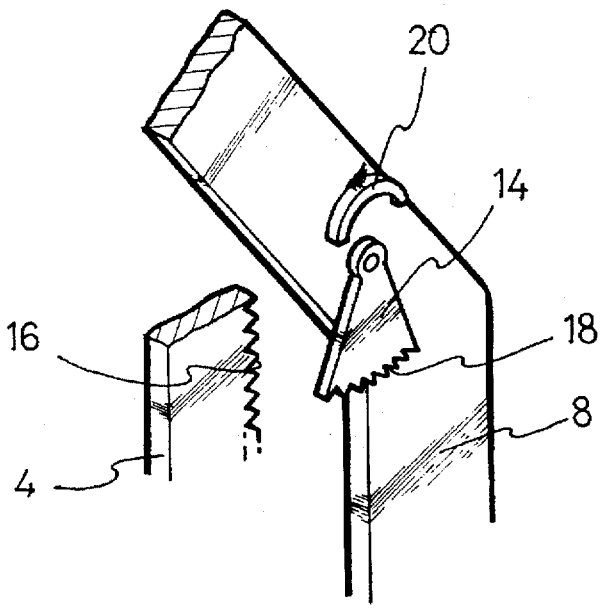
FIG. 2 is an exploded view showing the essential part of the present invention in accordance with a preferred embodiment of the present invention.
Figure 3:
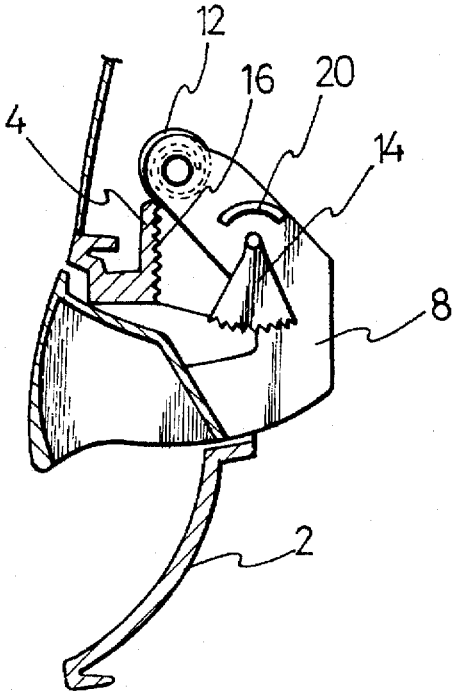
FIG. 3 is a side sectional view in accordance with a preferred embodiment of the present invention.

In this type of outside door handle assembly, as can be seen in FIGS. 2 and 3 of the present invention, a locking means is formed by the one side of the lever 8 and the supports 4 that support the lever 8.

The locking means includes a rotating member 14 that is fixed, in the central portion of one of the levers 8, so it can rotate. Also included is a hook portion 16 that prevents unintentional rotation of the outside handle 6 by latching on to the rotating member 14 when it rotates toward the outside.

The rotating member 14 is fan-shaped and towards its circumference, a saw-toothed portion is formed. The rotating member 14 has a predetermined mass.

The mass of the rotating member 14 is set according to the automobile in which it is used and to the operation scope of the locking means. In the present invention, the rotating member 14 is set to rotate when it receives a shock of 2–5 G (2–5×9.8 km/sec2).

There is no limitation to the above numerical value and it can be drastically adjusted depending on the type of vehicle and the needed operational scope.

The hook portion 16, which catches the rotating member 14 when it is rotating, is formed facing the rotating member during rotation. So as to enable the hook portion 16 to grab on to the rotating member 14, the present invention forms saw teeth on the part of the hook portion 16 that faces the rotating member 14. This hook portion 16 is formed towards the inside of the support 4 (which supports the outside handle 6).

As a result, if the rotating member 14 rotates toward the outside (clockwise when looking at the drawings), its saw-toothed portion 18 comes to face the hook portion 16.

Also, above the rotating member 14 on the lever 8, an arc-shaped projection 20 is formed to limit the rotation of the rotating member 14.

This arc-shaped projection 20, in order to prevent reverse rotation of the rotating member 14, resulting from vibration of the vehicle during operation, can be lengthened or shortened, depending on the particular requirements, as it is made of an elastic material.

Figure 4A:
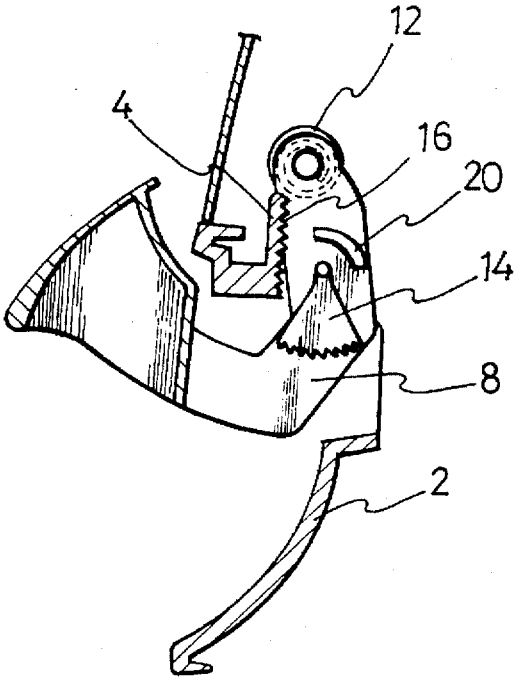
FIGS. 4 (A)(B)(C) show the present invention's operational states in accordance with a preferred embodiment of the present invention.

The locking device of the present invention in its normal state can be seen in FIG. 4A. As the rotating device naturally maintains a state where it is sagging down, there is no interference to the outside handle 6 when pulling it to open or close the door.

Figure 4B:
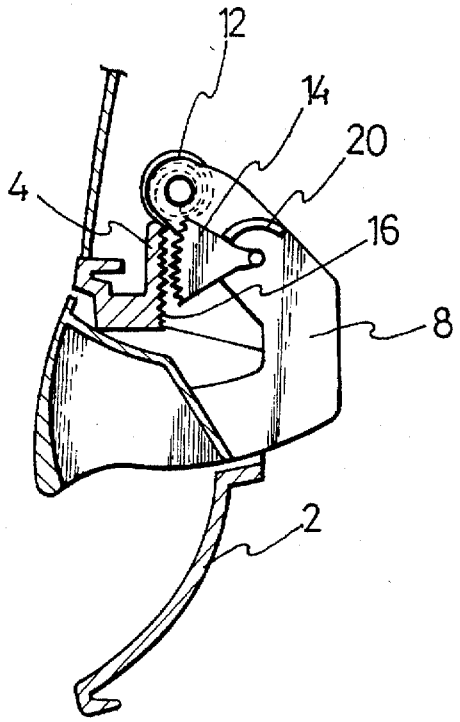
Figure 4C:
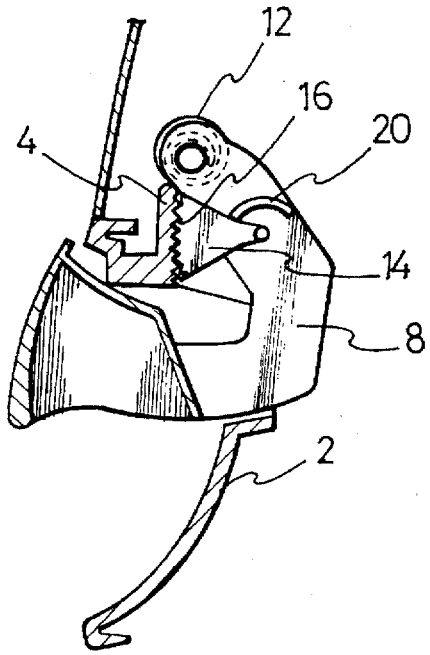

Also, if the door receives an impact from a side collision, the rotating member 14, with its fixed mass, rotates clockwise from the inertia caused from the impact as in FIG. 4B, and at the same time, the outside handle 6 also rotates clockwise.

By the action described above, the saw-toothed portion 18 of the rotating member 14 becomes interconnected with the hook portion 16 of the support 4. In this way, the outside handle 6 stops its rotation and the door is not permitted to open.

As a result, when the vehicle receives a shock from a side collision, the rotating member 6 acts as a support and the outside handle 6 is prevented from rotating.

Also, in the above process of operation, even if the shock is substantial, the arc-shaped projection 20 limits the rotation of the rotating member 14 so that it can not completely rotate. In this way, its saw-toothed portion 18 easily comes to be interconnected with the hook portion 16 and they firmly maintain this combined state.

Also, in establishing the length of the rotating member 14, it is set so the outside handle 6 does not rotate past 8 degrees in a collision.

In the present invention, the outside handle is automatically locked during a side collision. As this locking state is firmly maintained, the driver and passengers are kept safe.

Also, as the rotating member's operating scope is made smaller, the mounting space of the whole device is minimized and, as a result, the amount of available utilization space is enlarged.

While this invention has been described in connection with what is presently considered to be the most practical and preferred embodiment, it is to be understood that the invention is not limited to the disclosed embodiments, but, on the contrary, it is intended to cover various modifications and equivalent arrangements included within the spirit and scope of the appended claims.

What is claimed is:

1. An automatic locking device for an outside handle of an automobile door comprising:

a housing including a pair of spaced supports;

a hinge shaft supported by the supports;

a pair of spaced levers for supporting the outside handle for pivotal movement about the hinge shaft between open and closed positions;

an elastic member supported on the hinge shaft for biasing the outside handle to the closed position;

a rotating member fixed to one of said levers for rotation in response to an impact from a side collision; and a hook portion formed on a surface of a support and disposed to engage the rotating member upon its rotation in response to a side impact.

2. The automatic locking device according to claim 1, wherein the rotating member has a fixed mass so as to rotate when an impact force over a predetermined magnitude is imparted to a door, and includes a saw-toothed portion formed on an outside edge of the rotating member.

3. The automatic locking device according to claim 1, wherein a radial dimension of the rotating member is such that during a side impact collision, the outside handle cannot rotate sufficiently to unlock the door.

4. The automatic locking device according to claim 2, wherein the hook portion comprises saw teeth disposed to engage the saw toothed portion of the rotating member.

5. The automatic locking device according to claim 1, wherein a stop is fixed above the rotating member, on the lever, to limit the rotation of the rotating member.

6. The automatic locking device according to claim 5, wherein the limiting means is formed of an elastic material.

* * * * *